US005222629A

United States Patent [19]

Tal

[11] Patent Number: 5,222,629

[45] Date of Patent: Jun. 29, 1993

[54] DEVICE FOR SQUEEZING CONTENTS OF FLEXIBLE TUBES

[76] Inventor: Zeev Tal, 15 Asif St., 34637 Haifa, Israel, 90211

[21] Appl. No.: 926,549

[22] Filed: Aug. 5, 1992

Related U.S. Application Data

[63] Continuation of Ser. No. 661,548, Feb. 26, 1991, abandoned.

[30] Foreign Application Priority Data

Sep. 12, 1990 [IL] Israel ..... 95667

[51] Int. Cl.[5] ..... B65H 35/28

[52] U.S. Cl. ..... 222/103

[58] Field of Search ..... 222/95, 103, 105

[56] References Cited

U.S. PATENT DOCUMENTS

| | | | |
|---|---|---|---|
| 2,390,314 | 12/1945 | Massey | 222/103 |
| 2,638,250 | 5/1953 | Houldsworth | 222/103 X |
| 2,656,069 | 10/1953 | Fogarty et al. | 222/103 |
| 3,262,605 | 7/1966 | Madden et al. | 222/103 |
| 3,326,420 | 6/1967 | Turner | 222/103 |
| 4,159,787 | 7/1979 | Wright | 222/103 |
| 4,579,254 | 4/1986 | Puskarcik | 222/95 |
| 4,778,082 | 10/1988 | Vitelle | 222/95 |
| 4,928,851 | 5/1990 | Eatherly | 222/103 |

FOREIGN PATENT DOCUMENTS

| | | | |
|---|---|---|---|
| 2550955 | 5/1977 | Fed. Rep. of Germany | 222/103 |
| 3639365 | 5/1988 | Fed. Rep. of Germany | 222/103 |

*Primary Examiner*—David H. Bollinger

[57] ABSTRACT

A device for removing a desired quantity of a pasty substance contained in a flexible tube. The device comprises an integral structure including two elongated members at least one of which is resilient, connected by a frame. The elongated members define an opening which gradually narrows from a relatively wide entrance to a narrow slot, and are each separated from the connecting frame by a second slot permitting a resilient movement of at least one of said elongated members. A desired quantity of the content of the tube may be expelled by pressing the two elongated members toward each.

8 Claims, 3 Drawing Sheets

DEVICE FOR SQUEEZING CONTENTS OF FLEXIBLE TUBES

This is a continuation of copending application Ser. No. 07/661,548, filed on Feb 26, 1991, now abandoned.

FIELD OF THE INVENTION

The present invention relates to a device intended to facilitate the manual squeezing out of the content of a flexible tube of the type used for toothpaste, certain cosmetic preparations, gels, pasty food products and the like. Desired quantities can be squeezed out and the backward flow of the remaining content of the tube can be prevented.

BACKGROUND OF THE INVENTION

The manual squeezing out of the content of flexible tubes is an every-day operation carried out nearly in every household, a representative example being the squeezing out of a desired quantity of toothpaste from a flexible metal or plastic tube. Other examples are tubes containing various cosmetic products, hair treating preparations, shoe cream, etc. Further examples are tubes containing pasty food products like mayonnaise, ketchup, etc. One of the problems in this connection is the backward flow of the remaining content of the tube, another is that it is difficult to squeeze out the entire content of the tube, causing waste.

Various auxiliary devices are known, such as, for example, the device disclosed in U.S. Pat. No. 4,778,082, which is similar to the device of the present invention, yet has a constant width gap through which the tube is moved, and which is thus not fully effective in squeezing out the entire content of the tube. This prior art device has a constant gap through which the thick rear end of the tube is passed, or it has such a narrow end that the rear end of the tube has to be cut off before insertion. This is apt to cause spilling of the tube content.

Another device is disclosed in U.S. Pat. No. 4,159,787.

The prior art devices are not completely efficient as they do not remove essentially the entire content of the tube, they do not fully prevent the backward flow of the remaining content of the tube, or they are difficult to mount on the tube or be removed therefrom.

SUMMARY OF THE INVENTION

The invention relates to a device for the controlled removal of a desired quantity of the content of flexible tubes and which enables the essentially complete emptying of the content of such tube. The device is generally produced from a resilient plastic material, and is preferably an integral member which can be conveniently produced by techniques common in the plastics technology. The device can be produced, due to its simplicity and low cost, as a disposable device, and it can also be suitable for multiple uses with a plurality of tubes.

The device comprises a plastic member provided with means for passing the tube through a slot defined by two resilient members, connected by a frame at both pairs of corresponding ends thereof, or at one pair of corresponding ends thereof, which exert a certain pressure on the walls of the tube, and which also provides adequate pressure to prevent a backward movement of the device over the tube during its use and also acts as a barrier, preventing backward movement of the content of the tube. Also the resilience of its member enables it to pass over the thicker rear end of the tube.

The invention is illustrated by way of examples with reference to the appended schematical drawings, not in scale, in which.

DESCRIPTION OF PREFERRED EMBODIMENTS

Figure 1:
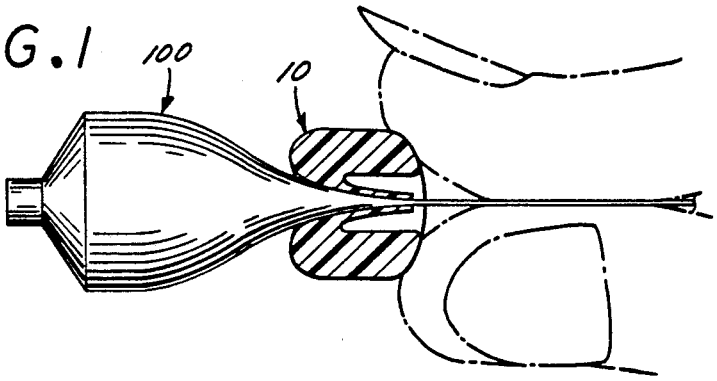
FIG. 1 is a section side-view of a device according to the invention, shown gripping a tube, and being manually manipulated.
Figure 3:
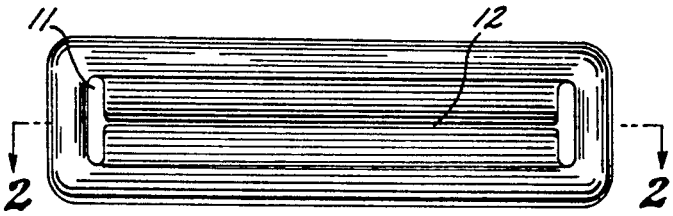
FIG. 3 is a front view of the device of FIG. 1.
Figure 2:
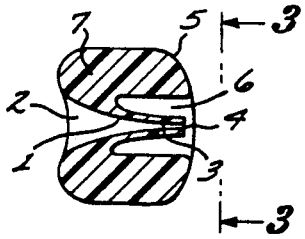
FIG. 2 is a sectional side-view of the device of FIG. 1.
Figure 4:
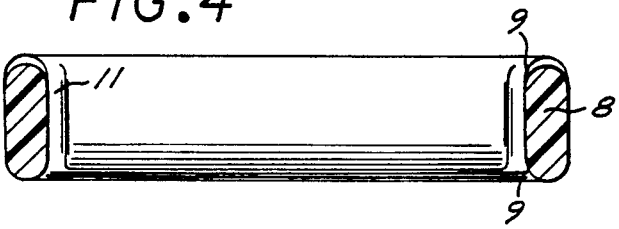
FIG. 4 is a cross-sectional view along the line 2—2 in FIG. 3.

As shown in FIGS. 1 to 4, the device of the invention (10), in FIG. 1 gripping tube (100), and manipulated by the user's fingers, comprises a plastic integral structure which comprises two elongated members (7), which extend into resilient flexible members (1), defining an opening which narrows gradually from the wide entrance port (2), to a narrow slot (3). The flexible members (1) extend along the width of slot (3) and are integral with the elongated members (7), which are part of the overall structure (10). The members (7) are integral with the connecting frame (8), defining rounded entrance and exit. Divergency (4) facilitates removal of the device from the tube, for multiple use. Slot (11) between the end of the resilient members and the sides of the connecting frame enables a flexible movement of these members. When in use, the rear end of the tube is forced through the slot with the narrow opening pointing to the rear part of the tube (100). Gentle squeezing on the rear end of the tube (100), by resilient members (1) presses out a desired quantity of its content, with the flexible members (1) exerting adequate pressure on the walls of the tube to prevent its backward movement and also any movement backwards of the tube content.

The device illustrated with reference to FIGS. 5 to 8, is similar to that of FIG. 1, but has only one resilient member (21) which exerts pressure on the tube walls. The tube is pulled through the slot, as shown by the arrow in FIG. 5. Side walls (28) have lateral flutings (26) on the front and rear sides, facilitating the pushing of the device to both sides of the tube.

FIGS. 9 to 12 again illustrate a slightly modified version of the device of FIG. 1, with two resilient tongues (41).

Figure 5:
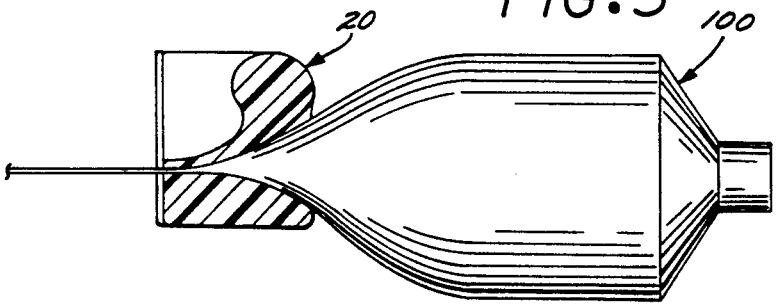
FIG. 5 is a sectional side-view of a modification of the device of FIG. 1 with FIGS. 6 to 8 being views equivalent to those in FIGS. 2 to 4, respectively.
Figure 6:
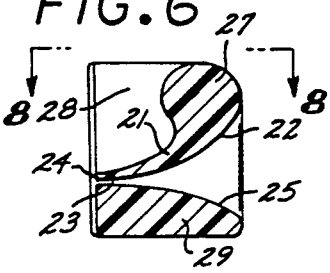
Figure 7:
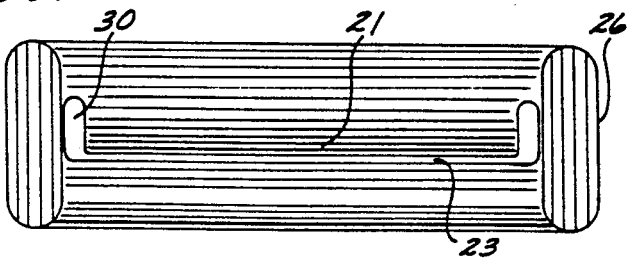
Figure 8:
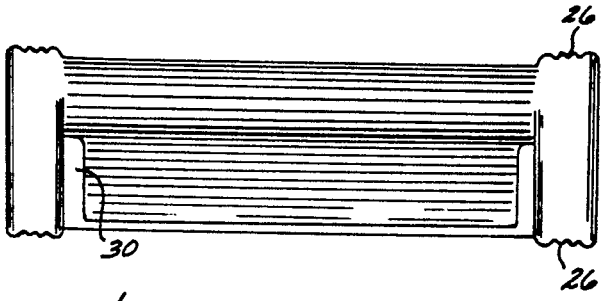
Figure 9:
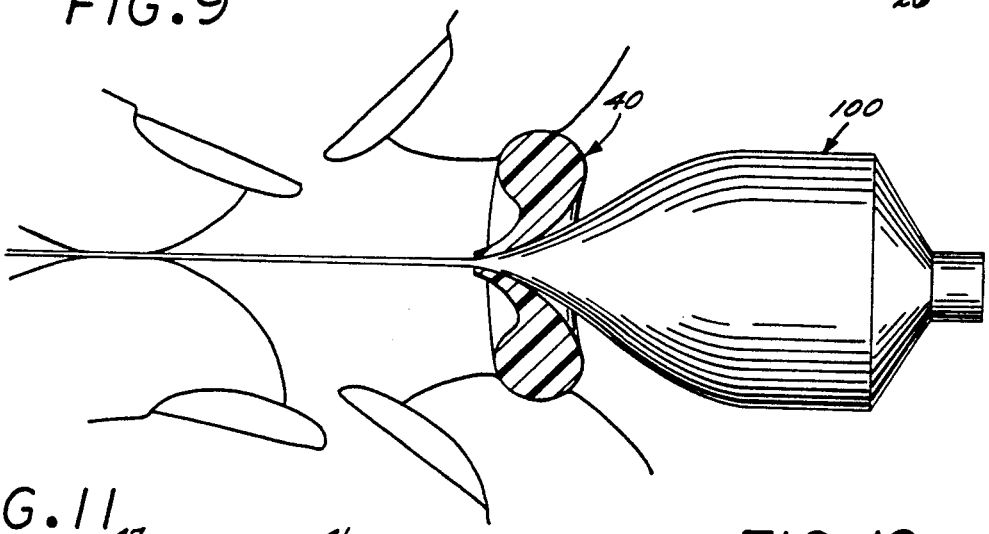
FIG. 9 is a cross-sectional view of another embodiment, with FIGS. 10 to 12 being views equivalent to those in FIGS. 2 to 4, respectively.
Figure 11:
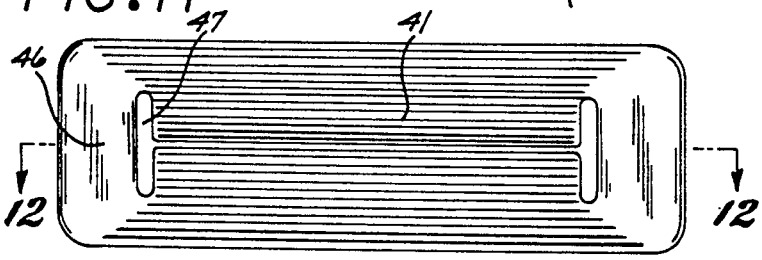
Figure 10:
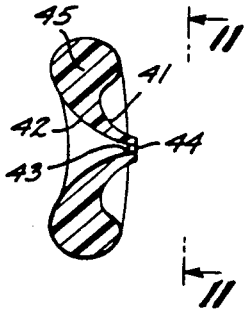
Figure 12:
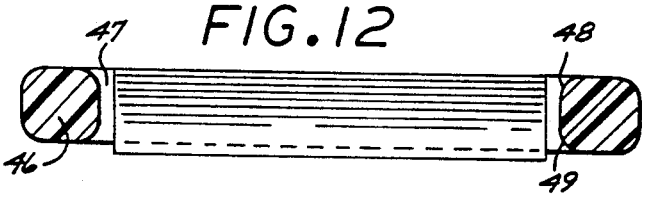
Figure 13:
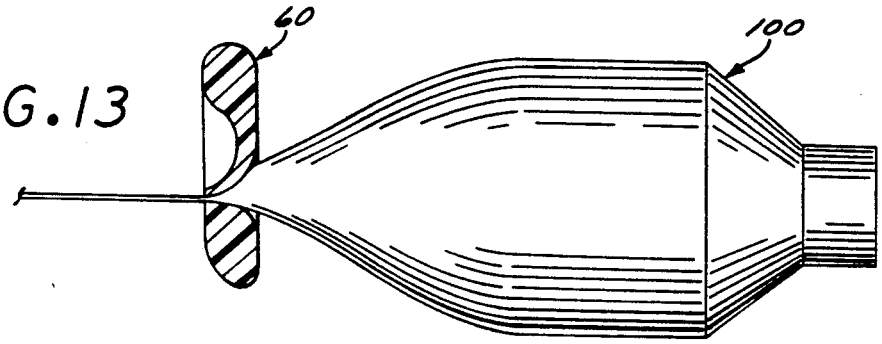
FIG. 13 is a cross-sectional view of yet a further embodiment, with FIGS. 14 to 16 being views equivalent to those in FIGS. 2 to 4, respectively.
Figure 14:
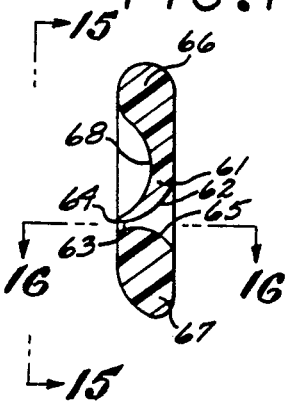
Figure 15:
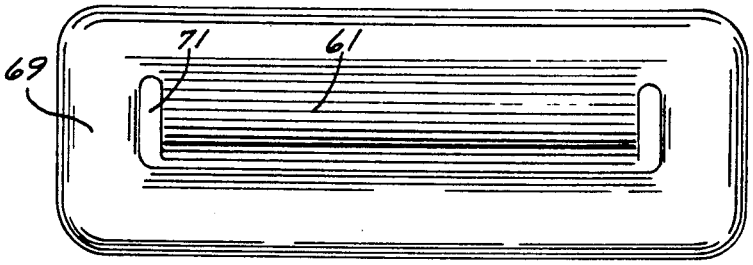
Figure 16:
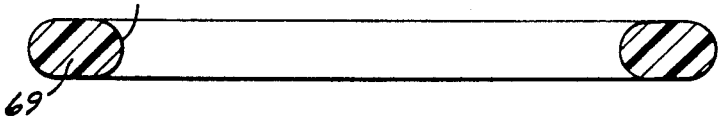

FIG. 13 is similar to FIG. 5, with a modified geometry. Also here, one of the tongues (61) is resilient and has a structure which prevents it from moving backward in any case whatsoever, since it is longer than and surpasses the slot. Thus, this device is disposable.

Figure 17:
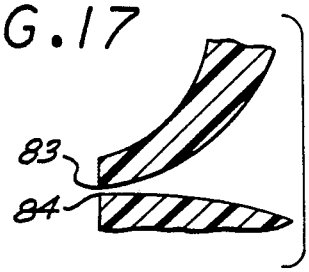
FIG. 17 is a cross-sectional view of the end of the gripping members, in this Figure such end having a small radius, preventing the device from slipping backwards over the tube.

The cross-sectional view of FIG. 17 is that of the ends of two gripping members (83) and (84), each end having a small radius to form sharp edges at their rear, which facilitate the gripping of the tube and improve closure, to prevent backflow of tube content, also preventing the device from slipping backwards over the tube when in use. The paste is removed from the tube by means of a device illustrated in FIGS. 1 to 4, by exerting pressure by two fingers, as shown in FIG. 1, and by pulling the rear end of the tube (100), by means of the fingers. The rear side of the device is curved and smooth so that the fingers slip thereon when exerting a pressure, causing it to move forward with respect to tube (100). The removal of paste from the device (20) illustrated with reference to FIGS. 5 to 8, is slightly different. Here pressure is exerted on flutings of the side walls (26), while the rear end of tube (100) is pulled backward in FIG. 5. At all times, members (21) and (29) engage the exterior surface of the tube (100) so as to prevent any backward flow of its content or the backward movement of the said device.

Figure 18:
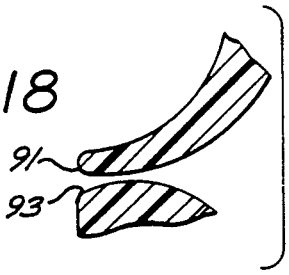
FIG. 18 is equivalent to FIG. 17, the end having a larger radius, which facilitates the removal of the device from an empty tube, for multiple use.

FIG. 18 is a cross-sectional view of the ends of gripping members 91 and 93, the end of gripping member 91 having a larger radius that the edges shown in FIG. 17 to facilitate the removal of the device from an empty tube to thus enable the device to be reused.

The device (40), illustrated in FIGS. 9 to 12, is operated in a manner similar to that of device (20), but it has a thin structure which facilitates packaging as an accessory within existing packages of tubes.

The removal of the content of tube (100) according to FIGS. 13 to 16, with the device (60), is similar to that of FIG. 5. Finger pressure is exerted on the member (69), while the rear end of the tube (100) is pulled backward. The device (60) is also of a preferred configuration having a construction which prevents it from slipping backward over the tube, since member (61) is longer than the gap with member (67), creating a strong grip on the tube when attempting to pull the device backwards. This is a most preferred disposable embodiment.

Figure 19:
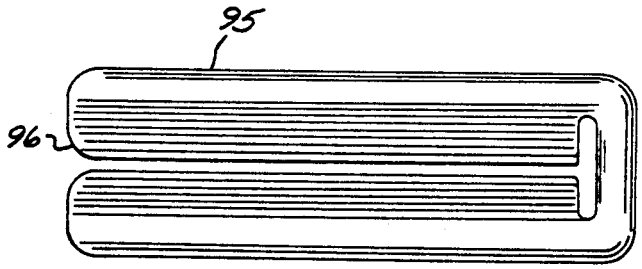
FIG. 19 is a front view of an open-frame embodiment.
Figure 20:
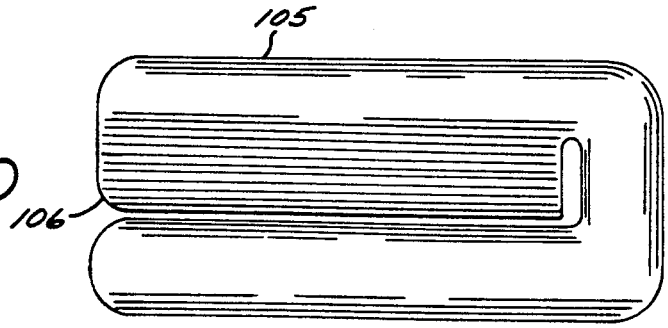
FIG. 20 is a front view of yet another open-frame embodiment.

As may be seen from FIGS. 19 and 20, the device according to the present invention may also have an open-frame structure. FIG. 19 illustrates a front view of device (10) and/or (40), shown in FIGS. 1 and 9, respectively, in which the resilient members are connected at only one end thereof, to form an open-frame structure. The port (96) is rounded, to ease mounting the device on the tube. The outer periphery (95) is designed so as to resist forces, stresses, etc., exerted during manipulation. FIG. 20 schematically illustrates a front view of yet another open-frame embodiment, more particularly the device (60) shown in FIG. 13, the resilient members being connected at one end thereof to form the open-frame structure. Also in this embodiment the port (106) is rounded to ease mounting on the tube and the periphery (105) adapted to resist deforming forces and stresses exerted during manipulation. The gripping members may be designed according to FIGS. 17 and 18 also for the open-frame embodiment.

The various embodiments of the device according to the present invention may be provided with means for suspension from suitable support means on a wall or, alternatively, with integral means for affixing the same to a wall.

While several specific embodiments have been described herein in detail, the invention is not limited thereto and is only defined by the scope of the appended claims.

I claim:

1. A device for removing a desired quantity of a pasty substance contained in a flexible or collapsible tube comprising an integral structure having first and second elongated members each having first and second end portions, said first and second elongated members each having a first surface, said first surfaces being substantially planar and substantially parallel to each other, said first and second end portions of each elongated member being joined by a first and a second frame member, respectively, said first and second elongated members defining an opening therebetween of a first width, said first elongated member having a first flexible portion and said second elongated member having a second flexible portion, said flexible portions extending in a direction away from said surfaces and at a converging angle in a manner whereby the edges of said first and second flexible portions form a slot of a second width, the width of said slot being less than the width of said opening, said first and second flexible portions being spaced from said first and second frame members in a manner permitting a resilient movement of said first and second flexible portions, the wall of said slot being selected such that said first and second flexible portions apply sufficient force to the walls of the tube positioned within said slot to maintain substantially all of said substance in the portion of said tube forward of said edges, movement of said device in said forward direction expelling said substance from said tube, and further wherein said edges of said flexible portions are of a radius to allow said device to be removed from the tube after the substance is expelled.

2. The device of claim 1 wherein the device is a one-piece, integral component.

3. The device of claim 1 wherein said device is plastic.

4. The device of claim 1 wherein said outer surfaces are substantially rigid.

5. A device for removing a desired quantity of a pasty substance contained in a flexible or collapsible tube comprising an integral structure having first and second elongated members each having first and second end portions, said first elongated member further having a first outer surface, and said second elongated member having a second outer surface, said outer surfaces being substantially planar and substantially parallel to each other, said first and second end portions of each elongated member being joined by a first and a second frame member, respectively, said first and second elongated members defining an opening therebetween, said first elongated member having a flexible portion which extends from said first elongated member in a direction away from said first outer surface at an angle and terminating in an edge wherein said edge of said flexible portion forms a slot of a second width with said second elongated member, the width of said slot being less than the width of said opening, said flexible portion being spaced from said first and second frame members in a manner permitting a resilient movement of said first flexible portion, the width of said slot being selected such that said flexible portions applies sufficient force to the walls of the tube positioned within said slot to maintain substantially all of said substance in the portion of said tube forward of said edge, movement of said device in said forward direction expelling said substance from said tube, and further wherein said edge of said first flexible portion is of a radius to allow said device to be removed from the tube after the substance is expelled.

6. The device of claim 5 wherein the device is a one-piece, integral component.

7. The device of claim 5 wherein said device is plastic.

8. The device of claim 5 wherein said outer surfaces are substantially rigid.

* * * * *